US005426896A

United States Patent [19]

Sloma

[11] Patent Number: 5,426,896

[45] Date of Patent: Jun. 27, 1995

[54] BUILDING METHOD AND APPARATUS

[75] Inventor: Robert M. Sloma, Cockfosters, England

[73] Assignee: Void Formers Limited, East Barnet, England

[21] Appl. No.: 98,400

[22] PCT Filed: Feb. 10, 1992

[86] PCT No.: PCT/GB92/00234

§ 371 Date: Aug. 11, 1993

§ 102(e) Date: Aug. 11, 1993

[30] Foreign Application Priority Data

Feb. 12, 1991 [GB] United Kingdom ..... 9102946
Mar. 25, 1991 [GB] United Kingdom ..... 9106289
Jul. 22, 1991 [GB] United Kingdom ..... 9115805

[51] Int. Cl.[6] ..... E04B 1/34

[52] U.S. Cl. ..... 52/2.13; 52/2.11; 52/741.1; 405/229

[58] Field of Search ..... 52/741.1, 743, 2.11, 52/2.13, 167 R, 226.5; 405/229

[56] References Cited

U.S. PATENT DOCUMENTS 4,191,496 3/1980 Becker ..... 52/226.5
4,624,383 11/1986 Moore ..... 206/509
4,771,581 9/1988 Nill ..... 52/167 R
4,978,021 12/1990 Mini et al. ..... 220/404
5,076,493 12/1991 Anderson ..... 220/288

FOREIGN PATENT DOCUMENTS 089051 3/1983 European Pat. Off. .
1519752 2/1967 France .
3611809 4/1986 Germany .
2120167 4/1983 United Kingdom .
2130524 4/1983 United Kingdom .

*Primary Examiner*—Carl D. Friedman
*Assistant Examiner*—Creighton Smith
*Attorney, Agent, or Firm*—Browdy and Niemark

[57] ABSTRACT

A method of building a structure on a substrate, said method including the steps of providing on the substrate a support arrangement capable of adopting a first, substantially rigid state whilst the structure is being built thereabove, and a subsequent, second state permitting the accommodation of movement of, and/or forces in, the substrate (e.g. due to heave). The support arrangement comprises fluid confinable means which, in the arrangement's first state, confines a fluid therein to a first space and is operable (via said fluid) to support the structure or at least parts thereof above the substrate, and which, in the arrangement's second state, does not confine the fluid and is either in a reduced space or is readily compressible to a reduced space by said movement and/or forces.

The fluid confining means may comprise a container comprising a flexible-walled main body and a closure member for the body, said closure member comprising, as at least part of its wall, an element degradable in a predictable manner with the intended fluid contents of the container. In a particularly preferred embodiment, the degradable element comprises a magnesium alloy to degrade in a predictable manner by the effect of water or a saline solution within the container.

36 Claims, 4 Drawing Sheets

BUILDING METHOD AND APPARATUS

TECHNICAL FIELD

This invention concerns methods of building structures, and arrangements for use in such methods, which are particularly advantageous when the substrate upon which the structure is to be built is liable to expansion and/or contraction.

BACKGROUND ART

Ground heave is a well known phenomenon, arising particularly but not exclusively in clay soils, in which the substrate expands (e.g. in the event of prolonged rain following a long period without rain, or after removal of a tree from adjacent a structure which upsets the substrate water balance) exerting large pressures on any structure built onto or into the substrate leading to cracking of the structure foundations and walls and—in the extreme—to the complete failure of the structure.

Clearly it would be possible to avoid this problem by ensuring that a void is provided beneath the lowermost part of the structure as it is built into which void the substrate may move—if subject to heave—without affecting the building thereabove. Such a solution is possible only if the lowermost part of the building is preformed since if it is being built "on-site" it needs to be supported—at least until it is sufficiently stable to stand on its own above the substrate.

To overcome this problem and permit structures to be built on substrates in which heave is likely to occur it has been proposed to provide a compressible volume between the parts of the structure in contact with the substrate and the substrate itself (notably the ground beams and ground slabs used in the structure).

One such known proposal is to provide a compressible foamed plastics material (e.g. expanded polystyrene) layers between the substrate upon which the structure is being built and the ground beams and ground slabs of the structure. Such a solution adds greatly to the safety of a structure, when the substrate on which it is built heaves, by reducing by partial absorption the stress transmitted to the structure. However, the compressibility of the plastics foams known to us is limited and the material always transmits a certain amount of loading to the structure. As a result the thickness of the foamed plastics layers required are much greater than would be needed if a complete void were provided beneath the structure (up to 2.5 times the thickness). This exacerbates another disadvantage—that of the foamed plastics layer compressing under the weight of concrete as it is poured.

Another known proposal provides a sandwich support arrangement having wood or fiber boarding mounted on either side of a central, fibrous paper-like honeycomb. When dry the central honeycomb section of the support arrangement will support the weight of wet concrete as it is poured, but when wet its ability so to do is considerably reduced. Such an arrangement offers advantages over the foamed plastics layers proposal and the support need be only 10–15 mm deeper than would have been a complete void.

A disadvantage of this proposal, however, is the need to keep the central honeycomb section of the arrangement dry for it to retain its strength whilst it is supporting, for example, concrete being poured to form a ground beam or a reinforced concrete ground slab. Thus when using arrangements embodying this proposal it is now becoming a common requirement completely to cover the support arrangement with a water impermeable sheet—e.g. polythene—to prevent the central honeycomb section of the arrangement collapsing under the weight of the concrete being poured (or even, prior to the concrete being poured, by the weight of bars placed on it to reinforce the concrete) following a shower of rain—or even from the effects of moisture in the concrete itself.

Further disadvantages of such a sandwich support arrangement are that, under certain conditions, it can (like other wood and certain cellulose products) biodegrade to form methane gas, which is dangerous (see 'New Civil Engineer' of Apr. 11, 1991), and that it can harbour and promote infestation and/or dry rot.

Objects of the invention include the provision of methods of building structures and of apparatus and arrangements for use in such methods which overcome or at least alleviate the above-mentioned and/or other problems or disadvantages of the prior art.

BRIEF SUMMARY OF EMBODIMENTS OF THE INVENTION

According to a first aspect of the invention there is provided a method of building a structure on a substrate, said method including the steps of providing on the substrate a support arrangement capable of adopting a first, substantially rigid state whilst the structure is being built thereabove, and a subsequent, second state permitting the accommodation of movement of, and/or forces in, the substrate beneath the structure, said method being characterised:

by the use of a support arrangement which includes a rigid surface part and a plurality of container means that can confine fluid, by positioning the said container means in mutually spaced apart relation on the substrate and the said rigid surface part on the plurality of mutually spaced apart container means so as to be supported thereby, by confining fluid in said container means such as to cause the support arrangement to adopt its said substantially rigid state and space the rigid surface part above the substrate to provide a void therebetween, by forming the structure whilst it is at least in part supported by the said support arrangement in said substantially rigid state, and by providing for the support arrangement to adopt its said second state by passage of fluid from the container means to permit accommodation of movement of and/or forces in the substrate beneath.

According to a second aspect of this invention there is provided a support arrangement for temporarily supporting at least part of a structure on a substrate, the support arrangement being capable of adopting a first, substantially rigid state whilst the structure is being built thereabove, and a subsequent, second state in which it does not contribute to support of the structure but permits the accommodation of movement of, and/or forces in, the substrate, characterised in that the support arrangement comprises a rigid surface part and a plurality of container means to be mutually spaced apart and to support the rigid surface part in spaced relation above the substrate below it, and in that each of the mutually spaced apart container means, in the arrangement's first state, is to confine a fluid therein to a first space and contribute (via said fluid and the rigid surface part) to the support of at least part of the structure in spaced relation above the substrate and, in the arrangement's second state, is not to confine the fluid but be either in a reduced space or be readily compressible to a reduced space by said movement and/or forces.

It will be appreciated that if the defining wall or walls of the fluid container means is/are of resilient material, the fluid container means will collapse resiliently to occupy a reduced space in the arrangement's second state. Where the defining wall or walls of the fluid container means can flex but nevertheless form the fluid container means as a self-supporting container, the latter—when no longer confining the fluid therein—will be readily compressible to a reduced space by said movement and/or forces.

Advantageously the container, in the arrangement's second state, is deformable by said movement and/or forces.

Preferably the said container means are separate from the said rigid surface part and are provided on the substrate at discrete locations prior to said rigid surface part being placed thereon.

In preferred embodiments of the invention, the discretely located, fluid container means space the structure (e.g. a concrete slab) above the substrate such that the entire area beneath the structure—except for the aggregate of the areas occupied by the discrete fluid container means—is automatically provided at the outset as a void which is able to accommodate heave of the substrate. Any heave forces tending to be transmitted to the structure via said discrete fluid container means, e.g. whilst the latter are still in their said substantially rigid condition, can thus be of a considerably reduced effect and can be reduced still further towards zero when the said condition is no longer maintained, i.e. when the arrangement is in its second state.

Each fluid container means preferably comprises, in the arrangement's said first state, a fluid tight, fluid filled container which is sealed such as to maintain a pressurised, substantially rigid condition but which is thereafter, in the arrangement's second state, unsealed enabling it to collapse and/or deform should the substrate therebeneath move.

Preferably, passage of fluid from the container means is by leakage therefrom.

Advantageously, the fluid is confined in said container means at above atmospheric pressure.

The said at least part of the structure may comprise a ground beam or a ground slab for the structure. It will be appreciated that, by providing a said support arrangement between the said at least part of the structure and the substrate thereunder only whilst the structure is being built, expansion of the substrate (particularly if a clay substrate) may thereafter take place without deleteriously affecting the structure.

In one embodiment, each of the said container means comprises expansible means, the method being further characterised in that, to initiate the arrangement's first state, each said expansible means is expanded to lift the said rigid surface part with respect to the substrate beneath it, each said expansible means is maintained in this expanded condition whilst said structure is built and at least in part supported upon the rigid surface part, and thereafter each said expansible means is allowed to contract to render the arrangement into its said second state and such that a void is formed between the substrate and the said at least part of the structure built thereover.

Desirably, in another embodiment, each fluid container means may comprise a container that is at least partially of a degradable material, the method being further characterised in that each container is sealed such as to maintain a pressurised, substantially rigid condition in the arrangement's first state, and the said material is allowed to degrade such that the container, after time, becomes unsealed, releasing the fluid therein, whereby the support arrangement can adopt its second state, and the container can collapse and/or deform should the substrate therebelow move.

By collapsing in this specific predictable and/or predetermined way, the support arrangement in effect provides a void between the substrate and the structure, or at least part of a structure, built thereover.

According to a third aspect of this invention there is provided a container for a support arrangement according to said second aspect of the invention, the container being at least partially of a degradable material.

Preferably the container comprises a flexible-walled main body and a closure member for the body, said closure member comprising, as at-least part thereof, a barrier element for contact by the intended fluid contents of the container and degradable after a generally predictable time of contact with said contents.

According to a fourth aspect of this invention there is provided a closure member for a container according to said third aspect of the invention, said closure member comprising, as at least part thereof, a barrier element for contact by the intended fluid contents of the container and degradable after a generally predictable time of contact with said contents.

Advantageously the degradable element comprises a biodegradable or an electrolytically or chemically degradable cap, plug or seal.

In a particularly preferred arrangement the degradable element comprises a magnesium alloy to degrade in a predictable manner by the effect of, and after a generally predictable time of contact with, water or a saline solution within the container.

A fifth aspect of the invention provides a building method for at least part of a building, the building method including the steps of locating a number of planar parts which together are operable to form shuttering for said at least part of a building in a trench in a substrate with fluid tight, fluid filled, flexible walled containers interposed between the said planar parts and the bottom and side walls of the trench, the containers being maintained rigid and substantially non-deformable whilst the said at least part of a building is being built and thereafter being enabled to be collapsed and/or deformed (e.g. thereby to provide a void that permits movement of the substrate without deleteriously affecting the said at least part of a building which has been built).

At least part of the fluid tight, fluid filled, flexible walled containers is degradable and will degrade after passage of time (falling within a generally predictable and/or predetermined short time span, e.g. 1 to 3 months) and after the building has been built. In this way the fluid within the previously pressurised container is allowed to escape and the container will collapse under the upward heave forces (and/or under the weight of the planar part thereabove) to provide a void that permits the substrate to heave without deleteriously affecting the said least part of the building which has been built.

Another aspect of the invention provides a shuttering arrangement for use in this last-mentioned method and which comprises a number of linked planar parts which are locatable in a trench in a substrate to form a framework in which said at least part of a building may be built, said planar parts being located in said trench with fluid filled, fluid tight, flexible-walled containers interposed between them and the walls of the trench, the containers being maintained rigid and substantially non-deformable whilst the said at least part of a building is being made and thereafter being enabled to be collapsed and/or deformed to provide a void that permits movement of the substrate without causing damage to said at least part of the building which has been built.

Said planar parts may be linked by webbing interconnecting said containers.

One preferred arrangement embodying the last-mentioned aspect of the invention comprises a plurality of containers linked by flexible pockets into which said planar parts may be passed to form said shuttering.

In all the above aspects of the invention the said fluid confinable means may be sealed (in the support arrangement's first state) by a chemically or electrolytically or biologically degradable closure member (e.g. a cap, seal or plug); the latter being such that once the structure has been built it is possible for the closure member (cap, seal or plug) to degrade, thereby unsealing the fluid confinable means whereby the latter no longer "confines" the fluid but allows the fluid therein to escape. As a result the fluid confining means can collapse and/or deform if the substrate begins to heave towards the structure.

It is envisaged that the fluid used to fill the or each container may comprise a gas (such as air) or a liquid (such as water), although it will be appreciated that other fluids may be used—for example salt water (preferably carbonated—or otherwise having a gas dissolved therein to pressurise the container).

BRIEF DESCRIPTION OF THE DRAWINGS

By way of example, embodiments of the invention will now be described with reference to the accompanying drawings in which.

DESCRIPTION OF THE EMBODIMENTS

Figure 1:
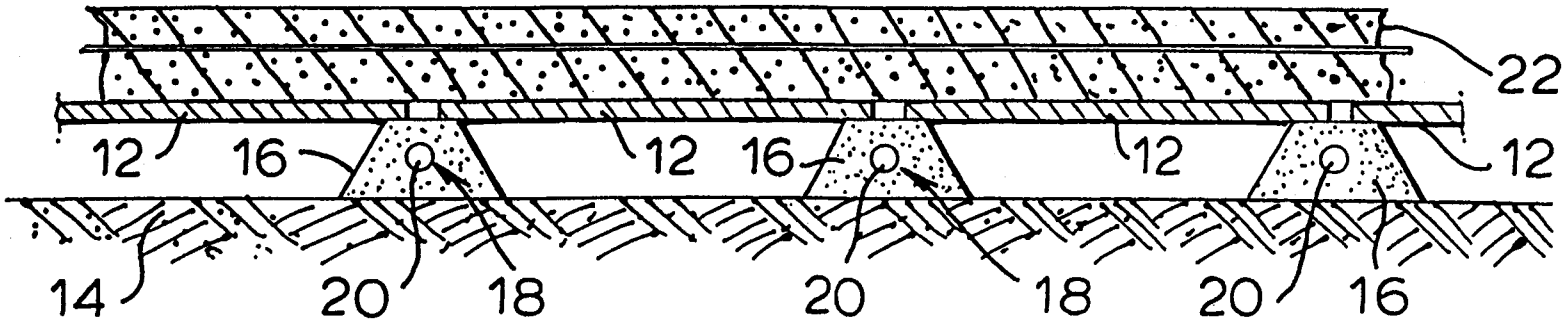
FIG. 1 schematically shows a side view of a first compressible support arrangement used in a method of the invention.

FIG. 1 shows a support arrangement, embodying the invention, to comprise a number of planar parts 12 disposed alongside one another. In this embodiment, the parts 12 comprise cement bonded particle boards—formed by compressing and curing a mixture of cement and wood chip particles—such as are sold by CP Boards Ltd of Manor Yard, Great Shefford, Berks, RG16 7DZ. The planar parts 12 are supported above a substrate 14—above which at least part of a structure is to be built—by a number of sealed, flexible walled, containers 16 of plastics material which underlie and support edges of the planar parts 12 as shown.

End walls of each container 16 are provided with apertures 18. After the container has been filled with water (preferably salt water) or other fluid, the apertures 18 are closed by a closure member, e.g. a cap, plug or seal 20. A slab 22 of concrete is formed on the planar elements 12—the slab being supported above the substrate by inter alia the fluid of the support arrangement.

Figure 2:
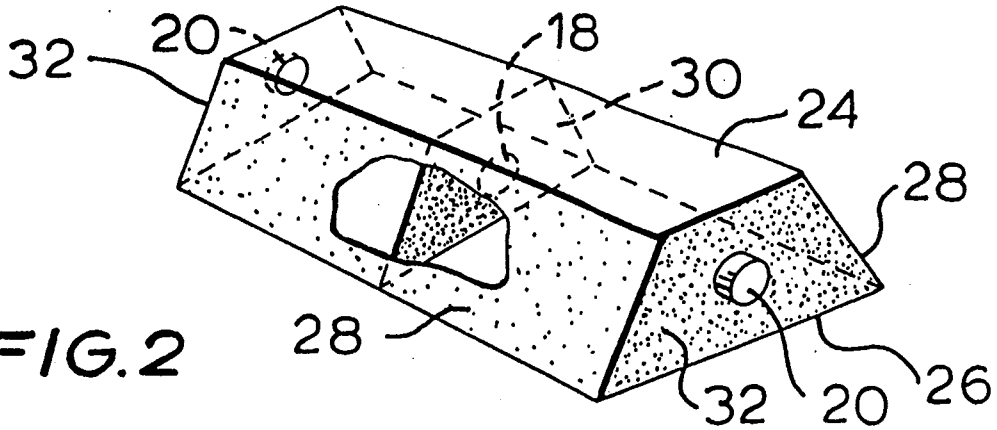
FIG. 2 is a schematic perspective view, to an enlarged scale, of a deformable container forming part of the support arrangement of FIG. 1.

Each fluid filled container 16 shown in FIG. 1 has generally the form shown in FIG. 2, that is to say it comprises a flexible walled container of plastics material with an upper wall 24 and a lower wall 26 which run generally parallel one to the other. In use the upper walls 24 support the planar elements 12 of the support arrangement and the lower walls 26 rest on the substrate 14. The distance between the walls 24 and 26 may be any desired distance, but will normally be in the range of 50 to 150 mm. The side walls 28 of the containers 16 can be parallel or can converge as they extend from the lower wall 26 to the upper wall 24 as shown. Each container may be provided of indefinite length (say 300 mm to 3 meters) and may have a number of cross walls 30—each of which is pierced by an aperture 18—preferably spaced 300 mm apart.

On site, each planar part 12 is supported on a predetermined array of a number of containers 16, each of predetermined length, either directly thereon or upon a narrow bridge plate (of inverted U-shaped cross section) that extends between and rests upon a pair of containers 16. Alternatively a single, variable length container having a plurality of cross walls 30 may be cut to length on site such that two outermost cross walls 30 form end walls 32 for the container. After filling the container with water (or a chemical, e.g. salt, in water solution) or other fluid, the apertures 18 in the end walls 32 of the variable length or the fixed length containers 16 are then closed by a closure member (such as a cap, plug or seal member) as indicated at 20. Each such closure member 20 has a wall portion that is of, or incorporates, a material having a substantially predetermined degradation rate such that it will, with passage of time, and within a generally predetermined or predictable short period (e.g. having a specific value in the range of 1 week to 3 months), degrade and thereby allow the fluid in the container to escape. For a container of fixed length only one such cap is required.

After the concrete of the slab 24 has cured, say 4–6 weeks after it is made, the predictably-degrading plugs 20 degrade to an extent removing their sealing effect on the containers and allowing the fluid within the container 16 to escape. Thereafter container 16 provides or acts as a void and can collapse due to the weight of the planar elements 12 (such that a further void is formed immediately beneath the slab 22 which has been built) and/or due to the upwards forces thereon from heave of the substrate 14—that is to say from the upwards rise of the substrate 14 towards the slab 22. In other words the support arrangement ensures that, if there is a movement, it will be contained within the void(s) and no damage will be done to the slab 22.

Thus the containers 16 act as substantially incompressible supports for the structure as it is being built but thereafter collapse providing a void permitting clay-heave or substrate movement towards the slab 22 without any deleterious effect on the slab itself or the structure thereabove.

The cap, plug or seal 20 can be of various forms but, in all the aforesaid arrangements co-operates with the body of the container to seal it such that the sealed container is substantially incompressible, the material of the container body being such that the container is by comparison readily compressible when it is unsealed.

Figure 3:
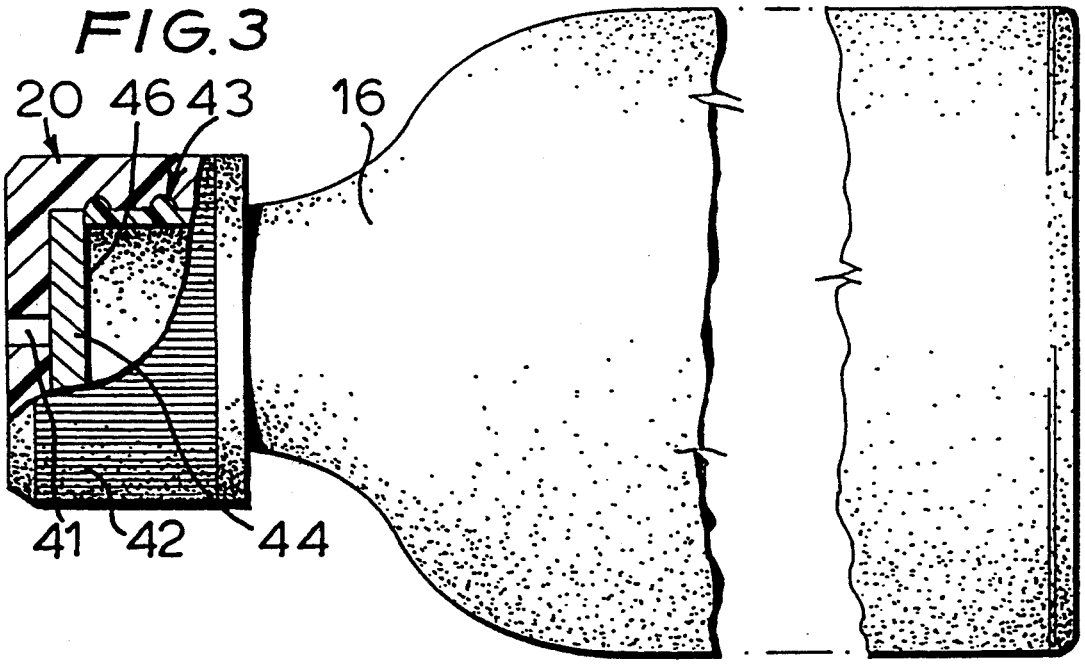
FIG. 3 is a schematic cross-sectional view of parts of one particular form of the container of FIG. 2.

In a preferred arrangement, each container 16 is a bottle blow-moulded of polyethylene teraphthalate (PET) plastics material to have a substantially parallelepiped form of approximate dimensions in the range 150 mm×200–300 mm×50–150 mm and an externally-threaded neck 43 (FIGS. 3 and 4) leading to an open mouth, e.g. of about 50 mm diameter. Such bottles can be produced with highly flexible walls of a thickness less than 1 mm yet, when filled with water and sealed by an internally-threaded closure member screwed onto the bottle's neck and mouth, are substantially rigid and can withstand an externally applied pressure of about 75 lbs/in$^2$ without bursting or being excessively deformed.

Figure 4:
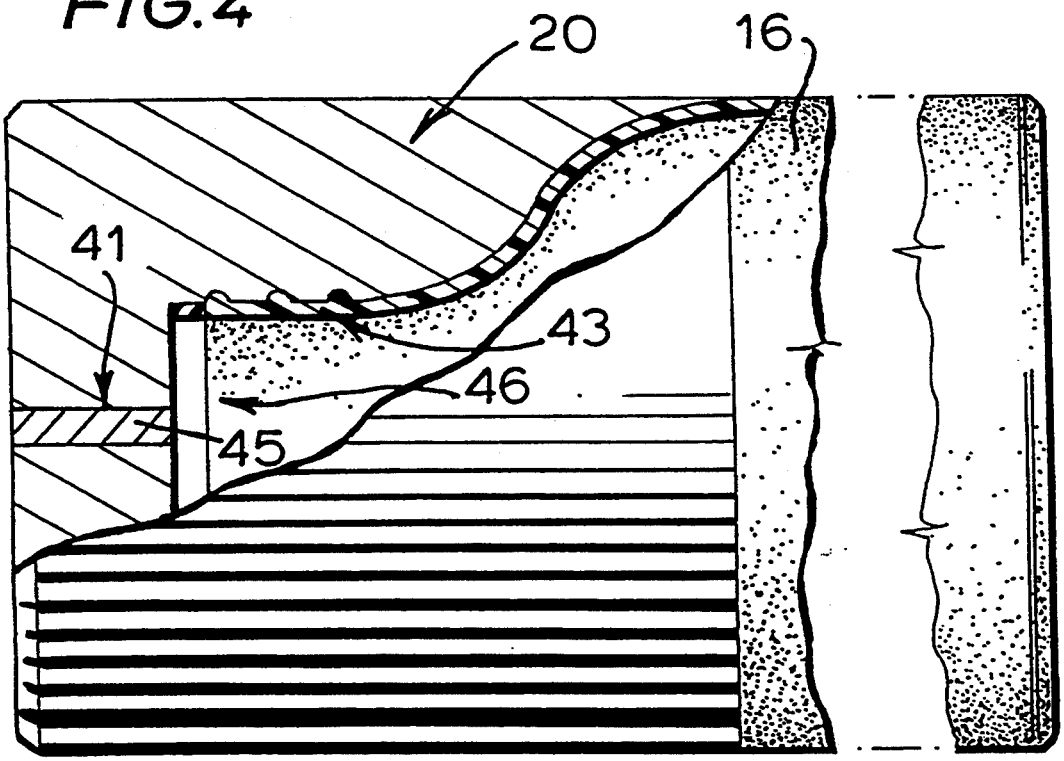
FIG. 4 is a schematic cross-sectional view of another particular form of the container of FIG. 2.

In one simple construction (see FIG. 3) the closure member 20 comprises a plastics material screw cap which has a small diameter bore or hole 41 in its bight wall 42 and has a disc 44 of a water soluble material, e.g. sodium stearate (soap), sandwiched between that bight wall 42 and the mouth 46 of the container 16 to cover—and seal—the hole 41. Alternatively, as shown in FIG. 4, a cylindrical slug of the water soluble material, e.g. sodium stearate (soap), can be wedged into the tubular bore or hole 41 (or a tubular nozzle or spout protruding axially and outwardly of the cap's bight wall 42) so as to seal it. With either construction the water soluble material is initially sufficiently impervious as to effect sealing of the container but in a predictable or predetermined period of time, e.g. approximately 2 months, will dissolve sufficiently in the fluid within the bottle so as to unseal from the cap and permit subsequent collapse of the container under heave forces.

In another construction, the cap's tubular bore or hole 41 (or the tubular nozzle or spout protruding axially and outwardly of the cap's bight wall 42) is fitted with a metallic insert 45 which, when exposed to fluid within the bottle or container 16, effects a chemical reaction causing decomposition of the insert 45. Such devices are considered very predictable as to the decomposition rate and it is thought can be produced to degrade predictably (into an unsealing condition) within a day or two of a prespecified, short time period (e.g. 7 days, 21 days, 2 months or 3 months).

The metallic insert 45 may comprise a cylindrical slug of a magnesium alloy—e.g. MAB1 obtainable from Castex Products Ltd—that is inserted as a close and tight sealing fit within the cap's tubular nozzle or spout. After filling the container 16 with water, the cap 20 is screwed on tightly and the sealed container then placed, with other similarly sealed containers 16, on the substrate 14 before being covered by one or more planar parts 12. If desired, salt or another chemical compound, e.g. in a previous sachet, may be inserted into each container 16 (prior to or subsequent to its being filled with water) to promote or assist in the degradation process. The chemical degradation of the magnesium due to the salt water (saline solution) is thought to be as follows:

$$Mg+2NaCl=MgCl_2+2Na$$

$$2Na+2H_2O=2NaOH+H_2$$

$$2NaOH+MgCl_2=Mg(OH)_2+2NaCl$$

In experiments it has been found that with a metal insert 45 consisting of a 5 mm diameter cylindrical slug of said magnesium alloy, a slug length of approximately 5 mm will chemically degrade to a cap-open state in about 20 days, and that a slug length of approximately 3.5 mm will chemically degrade to a cap-open state in about 10 days.

It will be appreciated that due firstly to the limited quantity of magnesium alloy required for each slug 45—which provides for the effective collapse of each container 16 by degradation of an element far smaller than the entirety of the container—and due secondly to the relatively large distances between the discrete containers 16, the very small quantities of hydrogen gas liberated by the degradation process will be widely dissipated so that the risk of any hydrogen-induced fire or explosion is minimal—if not zero.

In a particularly preferred arrangement, each container 16 is a bottle blow-moulded of polyethylene teraphthalate (PET) plastics material to have a substantially cylindrical form of approximately 150 mm diameter and a length in the range 100–300 mm, its externally-threaded neck, like the neck 43 leading to an open mouth, e.g. of about 50 mm diameter. As illustrated in FIG. 4, the separately-provided cap for this bottle 16 is "over-sized" in that it has an outer diameter similar to that of the bottle and has an axial length corresponding substantially to the axial length of the bottle's neck 43 whereby, when the cap is fully screwed onto the bottle, the bottle-plus-cap provides a generally cylindrical formation of substantially uniform diameter throughout its length.

The "over-sized" cap of this particularly preferred arrangement can usefully serve as a support for the bottle—either to contact the substrate or to contact the planar part 12 thereabove.

The cap 20 may be provided separately. If required, it can be shrink-wrapped to prevent pre-use attack by atmospheric moisture. In that case, the wrapping may be arranged such as to be automatically pierced when the cap 20 is screwed on to the container 16.

Also, with any of the aforesaid arrangements of the cap and bottle, a gas-producing water-soluble chemical compound or mixture, e.g. in a previous sachet (optionally the same sachet containing the salt or a different one), may be inserted into each container 16—prior to or subsequent to its being filled with water—to increase the internal pressure within the container 16 (e.g. to the order of 15 psi) so that the container is better able to support the loads thereon, e.g. due to the concrete and its associated reinforcements. For example, the gas-producing water-soluble chemical compound or mixture may be a mixture of sodium bicarbonate and tartaric acid in powder or granular form.

In yet another alternative arrangement, the degradation process may be effected by ground moisture alone and the containers 16 may be only air-filled.

It is envisaged that other chemically, biologically or electrolytically degradable devices may be provided in the closure member 20 including (but not limited to) constructions employing a molecular sieve or a sol-glass.

It will be appreciated that other variations may be made to the arrangements described. For example the containers need not be of the particular form shown and/or described above, but may be of any desired form—for example they may be cuboid in shape (a plurality of containers being provided at spaced locations along the length or breadth of the planar elements as desired). Again, if the containers are to support part of a structure being built on a piled foundation then they may be apertured—that is to say provided as a toroidal structure through which the pile support may extend.

Figure 5A:
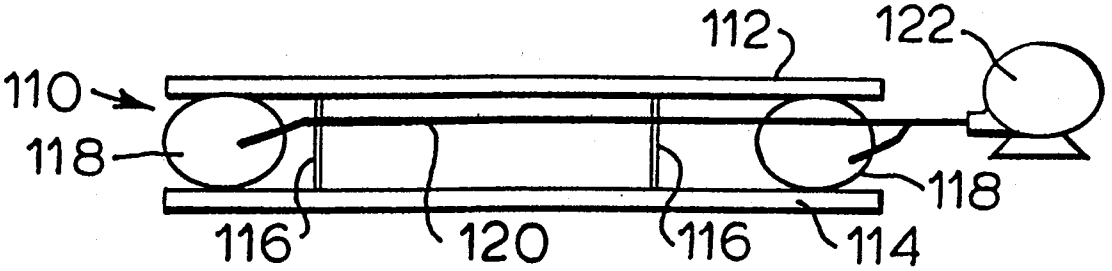
FIG. 5 shows schematically at A and B side an plan views of another support arrangement embodying the invention.
Figure 5B:
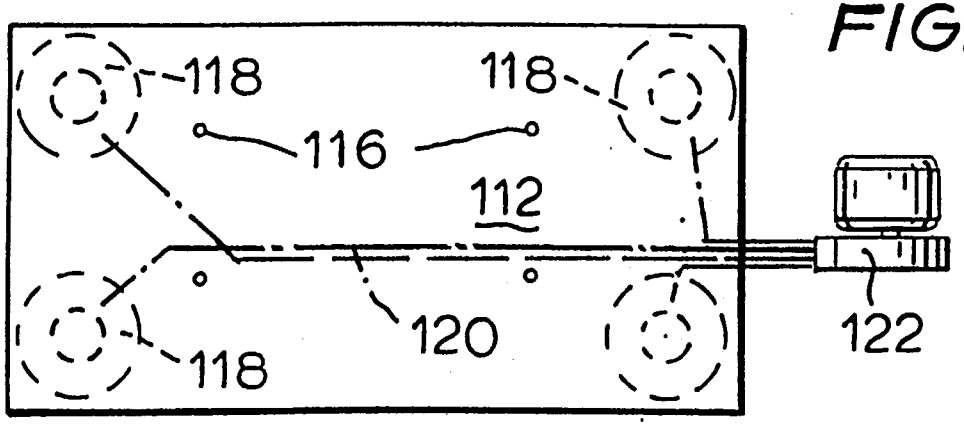

For example, as shown in FIGS. 5*a* and 5*b*, the support arrangement 110 comprises rigid upper and lower planar parts 112 and 114 of, for example, cement bonded particle board. The rigid upper and lower planar parts 112 and 114 are joined by a plurality of flexible (e.g. string) ties 116 each of which is firmly attached to those planar parts and is of a desired length (e.g. between 50 and 100 mm). Sandwiched between the upper and lower planar parts 112 and 114 are four flexible air tight elements 118 of natural or synthetic rubber individually and separately connected by air supply tubes or lines 120 coupling the support arrangement 110 to an air supply source (for example a compressor) shown diagramatically at 122. The elements 118 may simply be positioned between the planar parts as shown or be fixed in the positions shown in any suitable way (e.g. by an appropriate adhesive).

It will be appreciated that when air under pressure is supplied to the tubes or lines 120 from the source 122, the elements 118 will expand and push apart the planar parts 112 and 114 up to an amount determined by the length of the flexible ties 116.

The elements 118 which are provided between the planar parts 112 and 114 may comprise single bag formations or, preferably and as indicated in FIG. 5*b*, be provided as toroidal or ring structures.

The upper and lower planar parts 112,114 may alternatively be of any suitable wood, fiber or plastics material and in any event, may be sized to fit standardised building elements—for example ground beams—in which case the planar parts will be provided as single element sheets approximately 2000×40 mm.

The support arrangement 110 may be of any desired size—and may readily be adapted to different site requirements by cutting the cement bonded particle boards as required—making use of more or fewer elements 118 as needed. With cement bonded particle boards 8 ft by 4 ft (2500 mm×1250 mm) in length and breadth, each element 118 contacting the planar parts 112 and 114 has an area of contact, when fully inflated, of approximately 1 $ft^2$ (0.1 $m^2$). The thickness of the cement bonded particle boards may be selected—to suit site requirements—from the range of thicknesses available (e.g. from 6 mm–40 mm).

The air lines 120 coupling the elements 118 to the air supply 122 may include suitable valving (e.g. Schroder valves) enabling the air supply source 122 to be decoupled from the lines as desired.

As illustrated in FIG. 5*a* the air supply lines 122 feed to each of the elements 118 by passing in through the side of the support arrangement 110—that is to say between the two planar parts 112 and 114. It is envisaged that the arrangement described may be modified by providing that the air supply lines pass to the elements 118 directly through the planar parts to which they are attached (for example through planar part 112 or planar part 114).

In an alternative support arrangement (not shown), the two planar parts 112, 114 are significantly smaller than as shown in FIG. 5, e.g. being now each approximately 1 $ft^2$ (0.1 $m^2$), a single flexible element between them being substantially the same as the element 118 described with reference to FIG. 5. In this modification the air supply line 120 to the flexible element 118 (that is located between and adhesively attached to the planar parts 112 and 114) extends through the uppermost planar part 112. As before, ties 116 are provided to limit separation of the parts 112 and 114.

In building a structure with the support arrangements 110, the latter are provided along the ground (or substrate) and the elements 118 are then inflated by compressor 122 to enable the upper planar part 112 to provide a substantially rigid support, raised from the ground, for the concrete that is poured thereon (e.g. to form a ground beam or ground slab).

The support given by the inflated support arrangements 110 beneath the concrete ground slab or beam is sufficient to support the latter whilst the concrete cures and the structure becomes self supporting.

It will be appreciated that whilst the support arrangements 110 are maintained in their inflated state, the structure is held clear of the ground by an amount equal to the thickness (or height) of the inflated support arrangements 110.

Once the concrete of the structure has cured sufficiently for it to be self supporting, the compressor is disconnected from the air supply lines—or the valve(s) in those lines are opened—such that the air in the expansible means of the support arrangements 110 is released. With the reduction in air pressure the planar parts of the arrangements can move towards one another and voids can be established beneath the ground slab or beam and into which the substrate may expand without bearing upon and damaging the fabric of the structure built thereon.

In still another modification, the compressor 122 is omitted but the lines 120 are retained to serve as flexible fluid conduits to the elements 118. Prior to superimposing any concrete or other load upon the planar part 112, the containers 118 are filled with water or other liquid (optionally under pressure, e.g. by a soluble gas—carbonated water being most suitable) and the tubes or lines 120 then sealed—optionally by a degradable plug, cap or seal. The container is thus substantially incompressible and, via the liquid therein, will support the weight of the planar part 112 and the concrete to be poured thereon.

Once the concrete of the structure has cured, the sealed ends of the tubes may be ruptured—for example cut through where they project through at ground level. Alternatively the degradable seal can be allowed to degrade until the fluid can emanate from the containers 118.

It will be seen that should the substrate thereafter heave the containers 118 will be compressed and their walls will deform—there being no fluid pressure in the containers to maintain them in their original form—and any residual fluid remaining in the containers 118 will be expelled.

Thus the containers 118 act as substantially incompressible supports for the structure as it is being built but thereafter absorb or accommodate clayheave or substrate movement towards the structure and prevent such movement having a deleterious effect on the structure thereabove.

It will be appreciated that the lower rigid planar part 114 may be omitted in certain cases, e.g. where the substrate contains no sharp protrusions and/or where the lower surface of each container 118 is protected and/or is of a thicker material.

Figure 6:
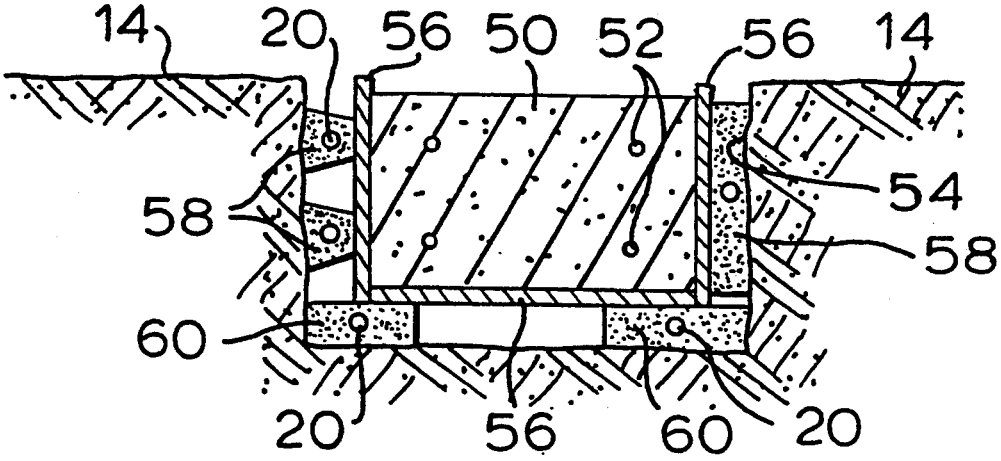
FIG. 6 is a schematic sectional end view of shuttering in use and employing elements embodying the invention.

FIG. 6 shows an embodiment of the invention in use for the formation of a ground beam 50, including reinforcing rods 52, in a trench 54. In accordance with this embodiment of the invention, planar parts 56 are provided beneath and to each side of the ground beam 50 which is being built, and these planar parts are spaced from the sides of the trench by fluid tight containers 58 and from the bottom of the trench by fluid tight containers 60.

Each container 58 and 60 may be, if desired, in substance the same as that shown in FIG. 2, 3, 4 or 5 and be provided with a similar biodegradable or a similar chemically or electrolytically degradable cap, seal or plug. It will be appreciated that the containers 60 serve to permit the accommodation of movement of, and/or forces in, the substrate's region below the finished beam, whereas the containers 58 at the sides of the beam serve to permit the accommodation of movement of, and/or forces in, the regions of the substrate beside the finished beam.

In the arrangement of FIG. 6 the side planar parts 56 may be freely supported in the trench—resting against the containers 58 at the side of the trench—or be fixed to those containers in any suitable way, such as for example, by means of a suitable adhesive such as Evostick.

Figure 7A:
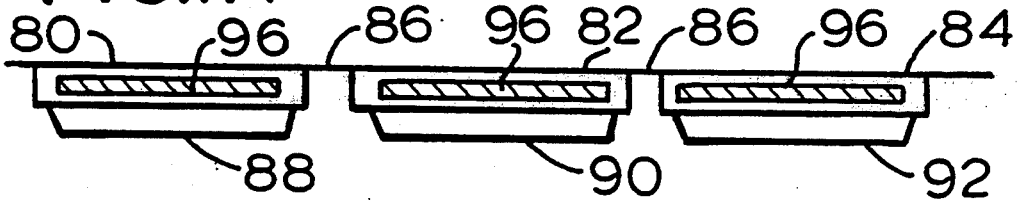
FIG. 7 shows a modified form of the shuttering shown in FIG. 6 as supplied (at A) and as used (at B).
Figure 7B:
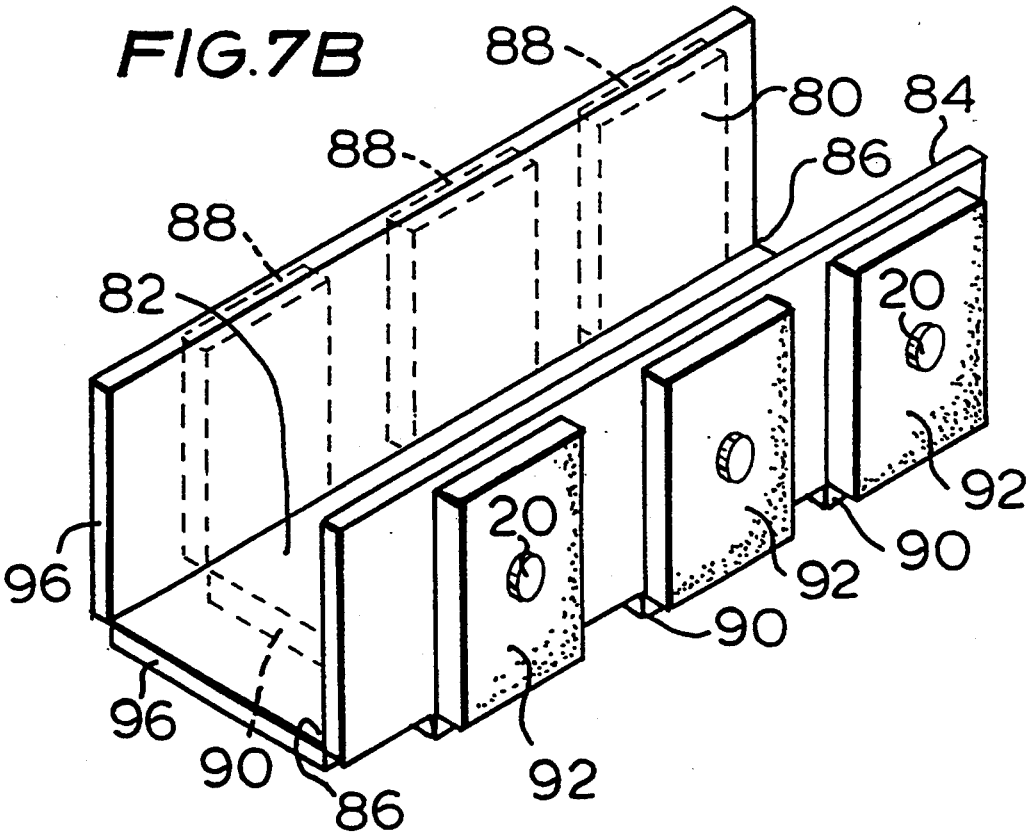

An alternative shuttering arrangement which is shown in FIG. 7 may however be used. This alternative shuttering arrangement comprises three flexible plastics pocket members 80, 82 and 84 interconnected by flexible plastics webbing parts 86. One surface of each of the pocket members 80, 82 and 84 carries thereon—has formed integrally therewith—a series of containers 88, 90 and 92 as shown.

The containers 88, 90 and 92 which are shown in FIG. 7 simply comprise flexible walled plastics containers each in substance the same as that shown in FIG. 2, 3, 4 or 5 and provided with a similar biodegradable or a similar chemically or electrolytically degradable cap, seal or plug. It will be appreciated that the containers 90 serve to permit the accommodation of movement of, and/or forces in, the substrate's region below the finished beam, whereas the containers 88 and 92 at the sides of the beam serve to permit the accommodation of movement of, and/or forces in, the regions of the substrate beside the finished beam.

In order to use the shuttering arrangement which is shown in FIG. 7 a planar part or member 96 is placed in each of the pockets 80, 82 and 84. The shuttering arrangement is then placed in a pre-dug trench with the containers 90 on the base of the trench and the containers 88 and 92 aligned with the sides of the trench. The containers 88 and 92 are fluid filled under pressure and then sealed.

The concrete for forming the ground beam or other structural element to be formed by the shuttering is then poured and once it has cured the biodegradable or chemically or electrolytically degradable caps, seals or plugs degrade unsealing the containers and allowing the fluid in the containers to escape and the containers to collapse.

It is thought the shuttering arrangement shown in FIG. 7, provides a ready and efficacious way of speedily allowing shuttering to be provided in a trench in which a ground beam is to be formed.

In an alternative arrangement, the containers 88, 90 and 92 need not be formed integrally with the pocket members 80, 82 and 84, but can be separate, individual containers (e.g. as in FIG. 2) located in their place.

With the arrangement shown in each of the above Figures the fluid used to fill the containers and keep them in a rigid condition whilst a structure is built thereabove may be any suitable fluid—for example gas (e.g. air) or liquid (e.g. water) or a gas-pressurised liquid (e.g. carbonated water).

It is possible for the fluid which is in the containers which acts to make them rigid and the support arrangements capable of supporting the building (or part thereof) thereover to be provided at atmospheric pressure or at an overpressure if desired.

Although, as described, the planar parts which are used in the various arrangements embodying the invention are of cement bonded particle board, it will be appreciated that any other suitably rigid boarding may be used—for example plyboard and/or chipboard.

Applicability of Embodiments of the Invention

It will be apparent that each of the above-described embodiments of the invention provides a support arrangement disposed between a substrate and at least part of a structure whilst the latter is being built, the support arrangement comprising at least one container which, whilst said at least part of the structure is being built, is filled with a fluid (either a liquid—e.g. water, or a gas—e.g. air, or a gas-pressurised liquid—e.g. carbonated water) and sealed or otherwise closed such as to be substantially rigid and/or relatively non-compressible when pressurised—by the downward load of the structure—but which, after the concrete has set, is unsealed or opened such that the interior and exterior of the container are in communication with one another to provide the conditions whereby the container is comparatively deformable and/or compressible—e.g. by the upward forces due to heave.

It will be appreciated that each of the above-described and/or illustrated embodiments of the invention provides a method of building a structure on a substrate and which comprises the steps of providing on the substrate a support arrangement which, whilst the structure is being built, is maintained in a rigid condition operable to support the structure or at least parts thereof above the substrate and which thereafter is not so maintained.

It is believed that the methods and arrangements above described are particularly effective in meeting the clayheave problem encountered in the building industry and in practical terms provide a void beneath a structure built on substrate likely to be effective to prevent any heave which might occur from adversely affecting the structure built thereon.

Other modifications and embodiments of the invention will be readily apparent to those skilled in this art. All such modifications and embodiments are to be deemed within the ambit and scope of the invention, and the invention is not to be deemed limited to the particular embodiment(s) hereinbefore described which may be varied in construction and detail without departing from the scope of the patent monopoly hereby sought.

I claim:

1. A temporary support arrangement to provide temporary support for part of a structure during erection of the structure on a substrate, said support arrangement having means for providing a supportive, structure-erection, first state whilst the structure is being built thereabove utilising a settable composition, and a non-supportive, post-erection, second state after said composition has set and the structure is self supporting, wherein said means comprises a rigid surface part and a plurality of containers:

wherein, when the said support arrangement is in use in said supportive, structure-erection, first state, said containers confine a fluid therein to a respective first space, are mutually spaced apart upon the substrate, support the rigid surface part in spaced relation above the substrate below it, and thereby contribute by way of said confined fluid and the rigid surface part to the support of at least pare of the structure in spaced relation above the substrate, and wherein, when the said support arrangement is in said non-supportive, post-erection, second state, said containers are collapsible to permit permanent expulsion of the fluid therefrom by movement due to heave forces in the substrate.

2. A support arrangement according to claim 1, wherein the said rigid surface part comprises a layer of rigid boarding, sheeting or the like.

3. A support arrangement according to claim 1, wherein the container means are arranged to leak (preferably over a substantially predetermined time) to effect transition between said first state and said second state of the support arrangement.

4. A support arrangement according to 1, wherein said container means are susceptible to containing said fluid at above atmospheric pressure when the support arrangement is in its said first state.

5. A support arrangement according to claim 1, wherein each said container means comprises expansible means, and further comprising means enabling the expansible means to expand and lift the rigid surface part with respect to the substrate whilst said at least part of a structure is built upon the rigid surface part and thereafter enabling the expansible means to contract to a permanently collapsed state such that in use a void is formed between the substrate and the said at least part of the structure built thereover.

6. A support arrangement according to claim 1, comprising a further rigid surface part which is in use located on the substrate, the first-mentioned and the further rigid surface parts being substantially in register with one another and the container means being located therebetween.

7. A support arrangement according to claim 1, wherein each said container means comprises a container which in use, whilst the support arrangement is in said first state, is initially sealed to prevent the container deforming, and which thereafter, whilst the support arrangement is in said second state, is permitted to collapse to a permanently collapsed state.

8. A support arrangement according to claim 7, wherein each said container is at least partially of a degradable material such that, when in said second state, the sealed container will become unsealed when the material degrades and can then collapse, releasing the fluid therein.

9. A support arrangement according to claim 8, wherein each said container comprises a flexible-walled main body and a closure member for the body, said closure member comprising, as at least part thereof, a barrier element for contact by the intended fluid contents of the container and degradable after a generally predictable time of contact with said contents.

10. A support arrangement according to claim 9, wherein the degradable element has a form selected from the group consisting of a cap, a plug, and a seal, and has a composition selected from the group consisting of a biodegradable material an electrolytically degradable material, and a chemically degradable material.

11. A support arrangement according to claim 9, wherein the degradable element comprises a magnesium alloy composition to degrade by the effect of, and after a generally predictable time of contact with, water or a saline solution contents contained within the container.

12. A container intended for use in a support arrangement according to claim 8, the container being at least partially of a degradable material.

13. A container intended for use in a support arrangement according to claim 8, the container comprising a flexible-walled main body and a closure member for the body, said closure member comprising, as at least part thereof, a barrier element for contact by the intended fluid contents of the container and degradable after a generally predictable time of contact with said contents.

14. A container according to claim 13, wherein the degradable element has a form selected from the group consisting of a cap, a plug, and a seal, and has a composition selected from the group consisting of a biodegradable material, an electrolytically degradable material, and a chemically degradable material.

15. A container according to claim 13, wherein the degradable element composition comprises a magnesium alloy to degrade by the effect of, and after a generally predictable time of contact with, the contents of the container, the latter being selected from the group consisting of water and a saline solution.

16. A closure member intended for use with a container according to claim 13, said closure member comprising, as at least part thereof, a barrier element for contact by the intended fluid contents of the container and degradable after a generally predictable time of contact with said contents.

17. A closure member according to claim 16, wherein the degradable element has a form selected from the group consisting of a cap, a plug, and a seal, and has a composition selected from the group consisting of a biodegradable material, an electrolytically degradable material, and a chemically degradable material.

18. A closure member according to claim 16, wherein the degradable element composition comprises a magnesium alloy to degrade by the effect of, and after a generally predictable time of contact with, contents of the container, the latter being in use selected from the group consisting of water and a saline solution.

19. A temporary support arrangement for a building structure, comprising a rigid planar part operative for building thereupon a structure, and a plurality of discrete, spaced-apart, containers that are located beneath said rigid planar part and on top of an underlying surface and that are filled with fluid to temporarily support said rigid planar part and the structure to be built thereupon at a spaced distance from said underlying surface, each of said fluid-filled containers comprising a bottleneck opening having a threadably engaged closure member operative to confine the fluid within said container, each said closure member further comprising a preselected degradable material which is chemically degradable by the fluid within said container after a substantially predetermined time such as then to permit fluid from said container to escape through its said opening and allow said container to collapse permanently due to movement of the underlying surface with respect to said rigid planar part.

20. A method of building a structure on a substrate, said method including the steps of:

a) providing a plurality of containers with fluid contents, b) closing the containers to confine the fluid contents therein and render the containers substantially rigid, c) positioning the containers in mutually spaced apart relation on the said substrate, d) disposing a rigid surface part upon the spaced apart containers thereby creating, between neighboring ones of said containers, voids between the substrate and said rigid surface part thereabove, (e) erecting the said structure utilising a settable composition whilst supporting it temporarily in part upon said rigid surface part and the substantially rigid containers therebeneath, and (f) after said composition has set and the structure is self supporting, arranging for the containers to be collapsible to a permanently collapsed state the fluid can be permanently expelled from said containers by heave forces acting thereon.

21. A method according to claim 20, wherein the step of closing the containers is by applying closure members to them.

22. A method according to claim 21, wherein the step of arranging for the containers to be collapsible is effected by arranging for the closure members to become permanently inoperative.

23. A method according to claim 20, wherein said structure comprises a ground slab.

24. A method according to claim 20, wherein fluid can be permanently expelled from the containers by leakage therefrom.

25. A method according claim 20, wherein the fluid is confined in said containers at above atmospheric pressure.

26. A method according to claim 20, wherein said structure comprises a ground beam.

27. A method according to claim 20, wherein each of the said containers comprises expansible means, the method being further characterised in that, to render the containers substantially rigid, each said expansible means is expanded to lift the said rigid surface part with respect to the substrate beneath it, each said expansible means is maintained in this expanded condition whilst said structure is built and in part supported upon the rigid surface part, and thereafter, following setting of said composition, each said expansible means is allowed to contract to said permanently collapsed state, such that a void is formed between the substrate and the said part of the structure built thereover.

28. A method according to claim 20, wherein each said container is at least partially of a degradable material, the method step of closing each container being by sealing it such as to maintain a pressurised, substantially rigid condition, and the method step of arranging for fluid in said containers can be permanently expelled therefrom being effected by allowing said material to degrade by contact with said fluid contents such that the container, after time, becomes unsealed, releasing the fluid therein, whereby the container can collapse permanently should the substrate there below move due to heave.

29. A method according to claim 28, wherein each said container comprises a flexible-walled main body and a closure member for the body, said closure member comprising, as at least part of a wall thereof, an element degradable in a predictable manner by reaction with the fluid contents of the container and wherein said method step of closing the containers consists of applying said closure members to said main bodies.

30. A method according to claim 28, wherein each container is provided with fluid contents comprising a saline solution and is sealed by applying a closure member incorporating a wall element of magnesium alloy located for contact by the saline solution.

31. A method of building a structure on a substrate, said method including the steps of:

(a) filling a plurality of containers with fluid, (b) applying closure members to said containers to close them thereby confining the fluid in the containers and rendering the containers substantially rigid, the said closure members each comprising, as at least part thereof, a barrier element for contact by the fluid contents of the container means and degradable by said contents after a generally predictable time of said contact, (c) positioning the closed containers in mutually spaced apart relation on the said substrate, (d) disposing a rigid surface part upon the spaced apart containers thereby creating voids between the substrate and the said part thereabove, (e) erecting the said structure whilst it is at least in part supported by the said rigid part and the substantially rigid containers therebeneath, and (f) after the structure is self-supporting, arranging for the closure members to become permanently inoperative such that the containers can collapse to a permanently collapsed state, and fluid therein can be permanently expelled therefrom, by heave forces acting thereon.

32. A method for constructing a support system for a building structure, comprising the steps of:

providing a rigid planar part operative for building thereupon a structure;

and providing a plurality of discrete, spaced-apart, fluid-filled containers beneath said rigid planar part and on top of an underlying surface to temporarily support said rigid planar part and the structure to be built thereupon a spaced distance from said underlying surface, each of said fluid-filled containers comprising a bottle-neck opening having a threadably engaged closure member operative to confine the fluid within said container, each said closure member further comprising a preselected degradable material which is chemically degradable by the fluid within said container after a substantially predetermined time and thereby operative to permit fluid to escape through its said opening and allow said container to collapse permanently due to movement of the underlying surface with respect to said rigid planar part.

33. The method of claim 32 wherein each of said closure members comprises a screw cap having internal threads corresponding to said container bottle-neck and a portion extending across said bottle-neck opening, said portion comprising a channel permitting fluid to communicate from inside to outside of the container, said chemically degradable material closing said channel and being contacted by said fluid within said container.

34. The method of claim 33 wherein said chemically degradable material comprises a magnesium alloy, and said container fluid comprises a saline solution operative to chemically degrade said alloy.

35. The method of claim 33 wherein said chemically degradable material is located within said channel.

36. The method of claim 33 wherein said channel has an open end facing said interior of the container, and wherein said chemically degradable material is located across said open end and in abutment of said portion of the screw cap.

* * * * *